United States Patent [19]

Araki

[11] Patent Number: 4,467,593

[45] Date of Patent: Aug. 28, 1984

[54] METHOD AND APPARATUS FOR AUTOMATICALLY CONTROLLING WINDING TENSION OF A ROVING IN A ROVING MACHINE

[75] Inventor: Hidejiro Araki, Toyoake, Japan

[73] Assignee: Seisakusho Kabushiki Kaisha Toyoda Jidoshokki, Kariya, Japan

[21] Appl. No.: 432,988

[22] Filed: Oct. 6, 1982

[30] Foreign Application Priority Data

Oct. 9, 1981 [JP] Japan ..... 56-161472

[51] Int. Cl.[3] ..... D01H 1/26

[52] U.S. Cl. ..... 57/96; 57/98; 57/264

[58] Field of Search ..... 57/92–96, 57/81, 99, 264, 265, 98

[56] References Cited

U.S. PATENT DOCUMENTS 3,986,330 10/1976 Kuttruff et al. ..... 57/264 X
4,056,926 11/1977 Stuber ..... 57/81
4,134,253 1/1979 Handa et al. ..... 57/264 X
4,168,604 9/1979 Mannhart ..... 57/265 X
4,375,744 3/1983 Briner et al. ..... 57/264 X

*Primary Examiner*—John Petrakes
*Attorney, Agent, or Firm*—Brooks, Haidt, Haffner & Delahunty

[57] ABSTRACT

A method and an apparatus for automatically controlling the winding tension of the roving in a bobbin lead roving machine is disclosed. The mean bobbin winding diameter $D_B$, bobbin r.p.m. $N_B$ and the flyer r.p.m. $N_F$ are measured automatically for one or more operating spindles, and a mathematical equation $(N_B/N_F-1)\times D_B=K$ representative of winding conditions for the roving is solved by automatic operation based upon the above measured values. When the value K thus obtained exceeds a preset control limit, the bobbin r.p.m. is decreased or increased automatically for correcting the value K towards its central setting for automatically correcting the winding tension of the roving.

10 Claims, 9 Drawing Figures

METHOD AND APPARATUS FOR AUTOMATICALLY CONTROLLING WINDING TENSION OF A ROVING IN A ROVING MACHINE

BACKGROUND OF THE INVENTION

This invention relates to a bobbin lead roving machine and more particularly to a method and apparatus for controlling the winding tension of the roving through adjustment of the bobbin r.p.m.

In a roving machine, the rate of increase in the bobbin diameter corresponding to increases in the number of roving layers on the bobbin is changed with changes in the roving conditions such as weight and kind of fibers, flyer r.p.m. or the number of twists. Hence, with a control method making use of a single set of cone drums, it is difficult to adjust the machine base so that the winding tension may be constant under all spinning conditions from the start of winding until the bobbin is full. Since fluctuations in the roving tension may cause fluctuations in roving weight and hence in the number of deniers of the resulting roving, high skill and experience are required of the operator to effect an adjustment of the roving tension.

Various mechanical devices have been proposed for realizing constant roving tension, such as roving tension correcting devices described in the Japanese Patent Publication No. 48652/1977 and the Japanese Utility Model Publication No. 13376/1977 in connection with a roving machine making use of cone drums as the means for changing the bobbin r.p.m. With these devices, a trial or tentative spinning operation is effected under given spinning conditions and the compensation or correcting system is manually set while the operator checks the roving travelling from the front roller to the flyer top as to tautness several times from the start of winding on the bobbin until the bobbin is full. This system is not completely satisfactory since the setting operation is complex and need be performed at several check points.

In order to obviate the manual setting, it is proposed by the Japanese Patent Publication No. 22532/1976 to detect the state of slack in the roving travelling from the front roller towards the flyer top by a photosensitive tube or to detect the deflecting state of the roving for controlling the roving r.p.m. automatically. However, this system is also not satisfactory because of difficulties in the correcting control based on mean values from plural spindles, and the possibility of issuing an erroneous correcting command when the spinning state is met in the single spindle control system. In addition, the numerical relation between the state of slack in the roving and the roving tension is not definite, thus making it difficult to control the bobbin r.p.m. accurately.

The roving machines currently employed are of the bobbin lead type in which the roving is wound on the bobbin on the basis of the difference between the bobbin r.p.m. and the flyer r.p.m. (winding r.p.m.) which is less than said bobbin r.p.m. The roving travelling from the front roller is subjected to a slight elongation (known as indefinite draft) while the roving is supplied through the slot in the main body of the flyer and flyer presser and wound on the bobbin, whilst the roving is twisted by the flyer rotation. Due to such draft, the winding speed of the roving is slightly higher than the spinning speed at the front roller. If a constant roving speed is desired, it is necessary to maintain this indefinite tension constant from the start of winding until the bobbin is full.

It is therefore an object of the present invention to provide a method for automatically maintaining the roving winding tension constant from the start of winding until the bobbin is full, through measuring the indefinite draft applied to the roving for correctly controlling the bobbin r.p.m.

SUMMARY OF THE INVENTION

With the above object in view, this invention resides in the method for automatically controlling the winding tension of the roving in the bobbin lead roving machine comprising automatically measuring the mean bobbin winding diameter $D_B$, bobbin r.p.m. $N_B$ and the flyer $N_F$ for one or more of the operating spindles, automatically calculating the equation representing the winding condition for the roving $(n_B/N_F-1)\times D_B=K$, and automatically increasing or decreasing the bobbin r.p.m. when the value K has exceeded a preset control limit for correcting the value K towards its central setting for automatically correcting the winding tension of the roving.

Furthermore, the invention resides in a device for automatically controlling the winding tension of a roving in a bobbin lead roving machine, said device comprising a non-contact distance measurement device adapted for measuring the bobbin diameter $D_B$ for one or more operating spindles, sensors for measuring the bobbin r.p.m. and flyer r.p.m., a micro-computer operative to calculate the equation representing the winding condition for the roving $(N_B/N_f-1)\times D_B=K$, to compare the resulting value K with a preset control limit therefor and to issue a corresponding correction signal when the value K has exceeded said control means, relay means operable by said correction signal, and means responsive to the operation of said relay means for changing the bobbin r.p.m.

BRIEF DESCRIPTION OF THE DRAWINGS

While the specification concludes with claims specifically pointing out and distinctly claiming the subject matter of the invention, it is believed the invention will be better understood from the following description taken in conjunction with the accompanying drawings, wherein:

DESCRIPTION OF THE PREFERRED EMBODIMENTS

Figure 1:
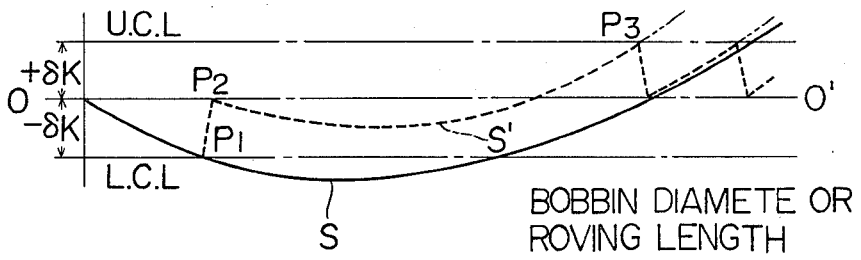
FIG. 1 is a diagram showing the principle of controlling the indefinite draft according to the present invention.

Since the winding speed of the roving is determined by the bobbin r.p.m. and the occasional bobbin diameter, the system of controlling the bobbin r.p.m. based on the measured values of the bobbin diameter and bobbin and flyer r.p.m.'s according to the present invention may be said to be reasonable as compared to the conventional method for spinning the roving under a constant tension. The principle of the present invention and the method for controlling the bobbin r.p.m. in accordance therewith is now described by referring to the accompanying drawings.

If the spinning speed from the front roller is V cm/min., the flyer r.p.m. $N_F$, the bobbin diameter $D_B$ cm and the occasional bobbin r.p.m. $N_B$, the roving winding condition for a bobbin lead roving machine is defined by $$(N_B - N_F)\pi \cdot D_B = a \cdot V \quad (1)$$

In this equation, the term $(N_B - N_F)$ represents the aforementioned winding r.p.m. and a the aforementioned indefinite draft. In other words, the indefinite draft a represents the ratio of the winding speed to the spinning speed V. An optimum value for the indefinite draft is selected in consideration of the machine construction and the spinning conditions and must be maintained constant from the start of winding until the bobbin is full. In the ordinary roving machine, the flyer r.p.m. $N_F$ and the spinning speed V are constant, so that the bobbin r.p.m. is inversely proportional to the bobbin diameter $D_B$. Thus, a control device making use of a positive infinitely variable speed changer (PIV speed changer) and a speed change cam or a hyperboloid cone drum are used for controlling the bobbin r.p.m. However, spinning the roving under a constant roving tension is a matter of great technical difficulty when only a single kind of the cone drum or cam is used for spinning the roving under varying spinning conditions, as mentioned above.

With the recent tendency towards large packaging and high roving speed, the roving is apt to break due to the centrifugal force acting on the roving wound on the bobbin. In order to cone with this inconvenience, it has been proposed in the Japanese Patent Publication No. 42855/1972 to decrease the motor speed continuously or intermittently with increase in the bobbin diameter. In such case, the pressure exerted by the flyer presser is changed with the number of revolutions which makes it more difficult to maintain the constant roving tension. Therefore, for the purpose of theoretical elucidation, the flyer r.p.m. $N_F$ is assumed to be variable. In effect, even supposing that $N_F$ is constant, the value of $N_F$ is thought to be changing slightly due to transmission loss or load fluctuations. Therefore, the value of $N_F$ may be reasonably treated as variable. In such case, the spinning speed V is given by the following formula.

$$V = b \cdot N_F \quad (2)$$

where b is a constant determined by the front roller diameter and the ratio of transmission of rotation from the flyer to the front roller. The value of b is determined unequivocally by the characteristics of the roving machine and the prevailing spinning condition (number of twist). The winding condition according to equation 1) may then be rewritten to $$(N_B - N_F)\pi \cdot D_B = a \cdot b \cdot N_F \quad (3)$$

$$\left(\frac{N_B}{N_F} - 1\right) D_B = \frac{ab}{\pi} = K \quad (3)'$$

Hence, $D_B$ is inversely proportional to $N_B/N_F$. In the above equation, K is a quantity including the indefinite draft a and hence will be used in the following description in place of indefinite draft a. From equation (3)', the bobbin r.p.m. $N_B$ is given by the following equation (4).

$$N_B = K \cdot \frac{N_F}{D_B} + N_F \quad (4)$$

This equation (4) is used in the present invention for precisely controlling the bobbin r.p.m. It is assumed that $D_B$ represents the bobbin diameter as measured at a given time point during spinning, and that $N_B$, and $N_F$ represent the bobbin r.p.m. and the flyer r.p.m. as measured at the same time point. It is also assumed that $K_O$ represents a design value for K (the value for K corresponding to the optimum slack of the roving between the front roller and the flyer top at the initial stage of winding on the drum) and K' represents the value for K corresponding to the above measured values and obtained from the above equation (3)'. An offset $\Delta K = K_O - K'$ is a measure of fluctuations in the roving tension, and a device for compensating the bobbin r.p.m. may be operated only when the offset $\Delta K$ exceeds a preset control limit $\pm\delta K$ for correcting the bobbin r.p.m. $N_B$ to a value defined by the above equation $N_B$. In this case, the bobbin r.p.m. need be corrected by a value $\Delta B = N_B - N_B'$ expressed by an equation $$\Delta B = \Delta K \cdot N_F / D_B \quad (5)$$

In FIG. 1, the value K is plotted on the vertical axis, and the bobbin diameter or spinning length is plotted on the horizontal axis. The horizontal line 00' represents a preset design value $K_O$ for K, and the value for K is changed as shown by a curve S when the bobbin r.p.m. is not compensated in the manner described above.

In the Figure, the curve S exceeds the lower control limit line L.C.L. at point $P_1$. At this time, the device for correcting the bobbin r.p.m. is set into operation for increasing the bobbin r.p.m. until the value K is equal to its design value $K_O$ at point $P_2$. Thereafter, the value K is changed as shown by a curve S' and exceeds the upper control limit line L.C.L. at point $P_3$. At this time, the device for correcting the bobbin r.p.m. is set into operation for decreasing the bobbin r.p.m. so that the value K equals to its design value $K_O$. By controlling the bobbin r.p.m. in this manner, the roving winding tension expressed by the value K may be controlled to be within an allowable limit from the start of winding until the bobbin is full.

The roving tension control device of the present invention is made up of measuring portions for respectively measuring the bobbin diameter $D_B$, bobbin r.p.m. $N_B$ and flyer r.p.m. $N_F$, a micro-computer portion for calculating the offset $\Delta K$ from the measured values for $D_B$, $N_B$ and $N_F$ supplied thereto and issuing an instruction when the offset $\Delta K$ has exceeded the control limit value $\pm\delta K$, and a bobbin r.p.m. control device portion responsive to said instruction for controlling the bobbin r.p.m. in the above manner.

Referring first to the measuring portions, the bobbin r.p.m. $N_B$ and the flyer r.p.m. $N_F$ can be measured by any existing r.p.m. sensor mounted to rotating shafts and transmitted as input signals to the micro-computer portion.

Figure 2:
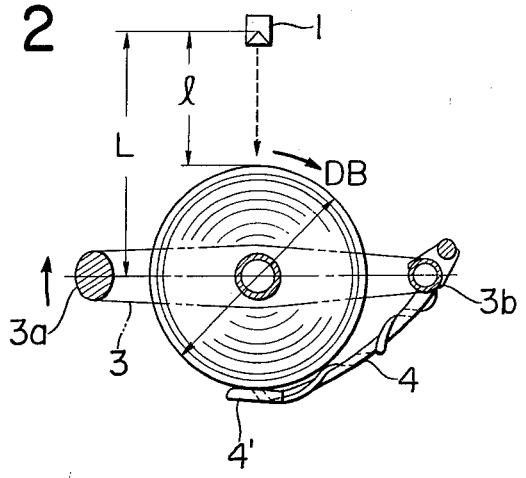
FIG. 2 is a plan view of the bobbin for illustrating the method of measuring the bobbin diameter.
Figure 3A:
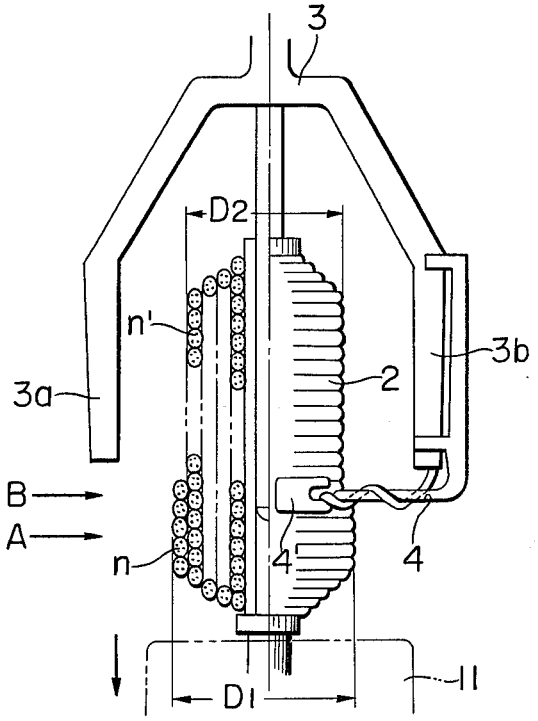
FIGS. 3A and 3B are front views of the bobbin.
Figure 3B:
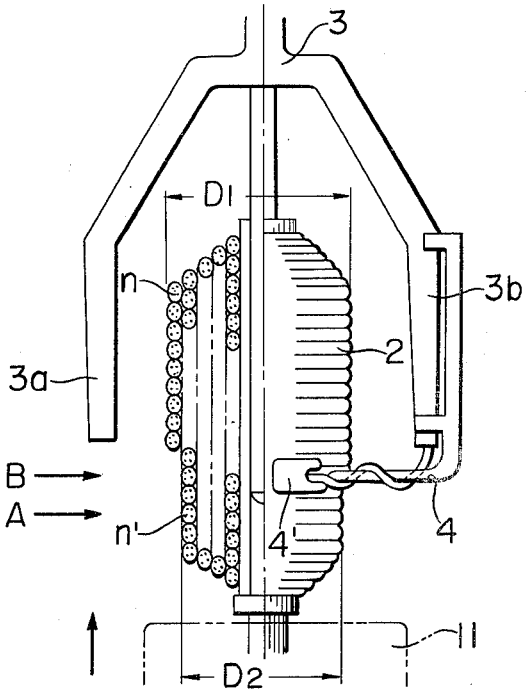
Figure 4:
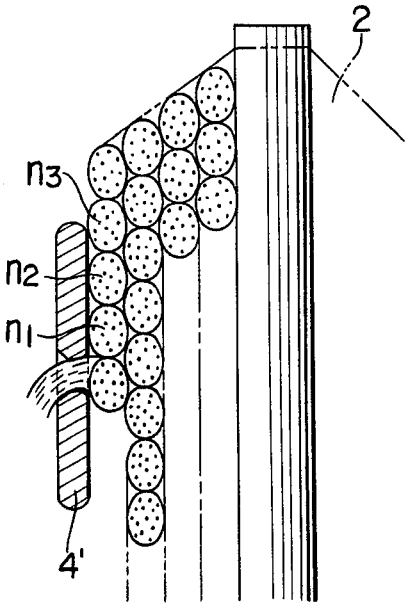
FIG. 4 is an enlarged sectional view showing the essential parts of the bobbin.

For measuring the bobbin diameter $D_B$ during bobbin rotation, it is possible to make use of a feeler type device which is contacted directly with the surface of the rotating bobbin for measuring its diameter. Such device tends to be complicated in structure since the bobbin is travelling vertically and has upper and lower conical portions. Moreover, the feeler is contacted directly with the bobbin surface and hence may insure the roving. Hence, the non-contact method is used in the present invention for measuring the bobbin diameter. Several non-contact methods making use of light beams such as laser or infrared beams, ultra-short electromagnetic waves or supersonic waves are so far known and utilized for measuring the distance with high accuracy. One method for measuring the bobbin diameter by using such non-contact distance measurement method is shown in FIG. 2, wherein the bobbin diameter is obtained by measuring a distance l from a base point 1 of the measuring device to the surface of a bobbin 2. In FIG. 2, L designates a distance between the base point 1 and the center of the bobbin 2. The numerals 3*a*, 3*b* designate flyer legs and the numeral 4 designates a flyer presser. Reference is made to FIGS. 3*a* and 3*b* for describing the measuring position lengthwise of the bobbin. Assuming that the bobbin diameter is measured at point A on the roving surface, when the bobbin 2 is travelling down as shown in FIG. 3 A, it is the outside diameter of a newly formed layer n that is measured by the measuring device. On the other hand, when the bobbin 2 is travelling up as shown in Fig. 3B, it is the outside diameter $D_2$ of a layer n′ preceding to the newly formed layer that is measured by the device. The bobbin diameter $D_B$ is given in the above equation by $(D_1+D_2)/2$. However, these values $D_1$ or $D_2$ may be used optionally if due allowances are made in the selection of the value K in the above equation (3)′. Therefore, $D_1$ or $D_2$ considered to be the same as the aforementioned bobbin diameter, as the case may be. For realizing the same measuring conditions, it is necessary to perform the measurement only during the upward stroke or downward stroke of the bobbin. In this case, the roving tension is corrected only for each other layer, which however is practically acceptable. With the measuring position A as mentioned above, it is necessary to take the mean value because the outer periphery of the roving layer is formed by the helically wound roving with a circular cross-section and presents an irregular surface. With a measuring position B corresponding to a mid height of a battledore plate 4′ of the flyer presser, it is possible to measure the outside diameter $D_1$ of the layer of the roving extracted from the battledore plate 4′ of the flyer presser without regard to whether the bobbin 2 is making an upward or downward stroke. In this case, however, it is necessary to provide a device for synchronizing the measuring operation with the flyer movement so that the measurement may be performed at the outer periphery of the bobbin where the flyer presser 4 does not hinder the measuring operation.

According to another effective non-contact measuring method, the bobbin diameter is measured, not by directly measuring the distance from the base point of the measuring device to the bobbin surface, but by measuring the distance between the base point of the measuring device and an intermediary member mounted for permanently contacting with the outer bobin surface. The flyer presser is most preferred as such intermediary member. The flyer presser is mounted to the main body of the flyer and plays the role of guiding the roving and applying a pressure to the outer bobbin surface under a centrifugal force caused by flyer rotation so that the roving may be wound tightly on the bobbin. Inasmuch as the outer bobbin surface is dented slightly at the contact portion with the presser under the pressure exerted from the presser, and the roving is wound at this dented portion on the bobbin, it is evidently most effective to measure the bobbin diameter at such contact portion. When the presser is used as intermediary member, the outside diameter of the roving layers on the bobbin can be measured without regard to whether the bobbin is travelling up or travelling down, as discussed with respect to the measuring position B in FIGS. 3A and 3B. Moreover, the mean bobbin diameter can be measured advantageously since the presser battledore plate 4′ is pressured against plural adjacent turns of the roving. In addition, the presser is usually of metallic material, and a member of the shape and material suitable for measurement can be mounted to the presser battledore plate, thus facilitating the measurement through non-contact measuring process.

Figure 5:
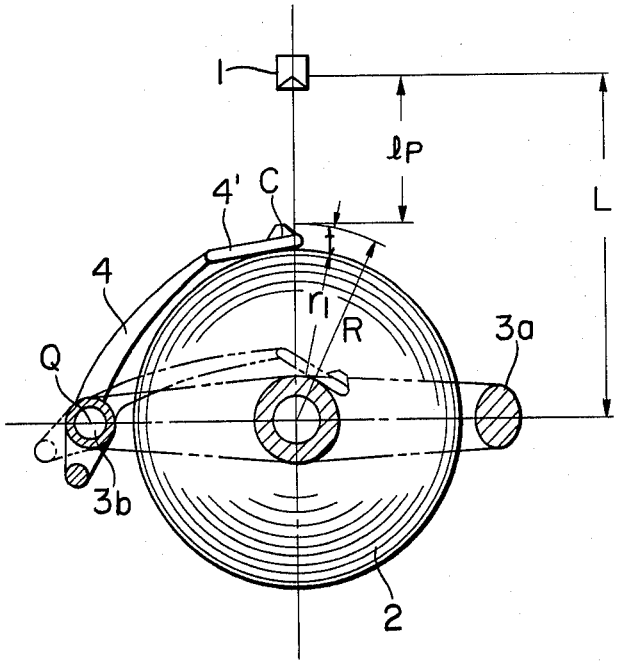
FIG. 5 is a plan view of the bobbin for illustrating a modified measuring method.

FIG. 5 shows a method of measuring the bobbin diameter with the aid of such flyer presser. In the Figure, the presser 4 is shown by the double-dotted chain line when at the start of winding and by the solid line when the bobbin is nearly full. The presser is mounted for rotation about an axis Q of a flyer leg 3*b* and may be moved from the double-dotted chain line position 4*a* to the solid line position 4 with increase in the bobbin diameter. It is to be noted that the presser is shown to be rotatable about axis Q only for simplicity of the drawing and the axis of presser rotation is not necessarily coincident with the axis of the flyer leg. If the distance between the base point 1 of the measuring device and a point C of the maximum radius of rotation R of the battledore plate 4′(or more precisely of a measuring member if one is provided as shown in FIG. 5) relative to the bobbin center is $l_p$, the difference between the radius R and the occasional bobbin radius r, corresponding to thickness of battledore plate 4′is t; and the distance between the point 1 and the bobbin center is L, the bobbin radius r, can be measured by the equations $L-L_p=R$, $R-t=r_1$, by measuring the distance $l_p$. However, the difference t is not always constant, since the presser contact angle is changed with the bobbin diameter. If such change in the contact angle is not negligible, the radius R is changed with the bobbin diameter. It is therefore preferred to find the value R for the range of changes in the bobbin diameter in advance and store the relation in a micro-computer. The bobbin diameter can then be measured through measurement of the distance $l_p$ and without regard to the changes in the quantity t. It is however necessary to control the measurement operation so as to be synchronized to the flyer rotation so that the rotating flyer legs 3*a*, 3*b* may not prove to be a hindrance to the measuring operation.

Figure 6:
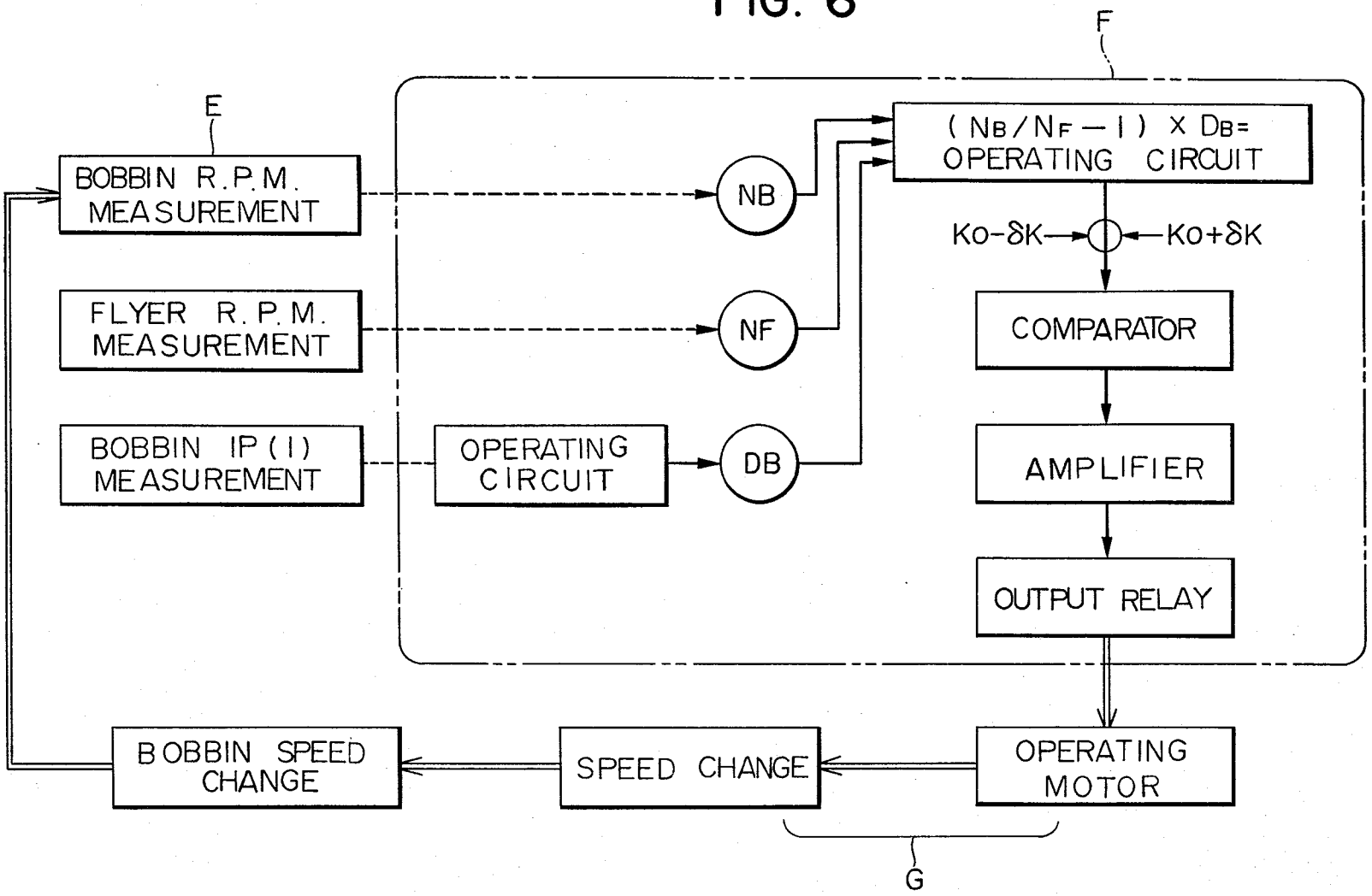
FIG. 6 is a block diagram showing the bobbin r.p.m. control portion and the micro-computer portion of the inventive control device.

FIG. 6 shows in a block diagram the structure of the micro-computer portion of the control device. In the drawing, E designates the measurement portion, F the micro-computer portion, and G the bobbin r.p.m. control portion. The micro-computer portion E is made up of three essential operating sections, namely, $D_B$ operating circuit for calculating the bobbin diameter $D_B$ and mean values of plural bobbin diameters based on the distance $l_p$ (FIG. 5) or distance l (FIG. 2) measured by the non-contact measurement device, a K operating circuit for calculating $K=(N_B/N_F-1)\times D_B$ from $D_B$, measured value for bobbin r.p.m. $N_B$ and flyer r.p.m. $N_F$, and a comparator circuit for finding the offset between K and $K_O$ and comparing the resulting offset with the control limit $\pm\delta K$. In addition, a memory circuit is provided for storage of a set of design values $K_O$ corresponding to changing bobbin diameters, in cases where the resistance offered to the roving is changed with the bobbin diameter and such change in the resistance is not negligible. An amplifier circuit for receiving and amplifying the output signals from the comparator circuit and an output relay circuit for forward or reverse operation of the electric motor associated with the bobbin r.p.m. control device may also be provided in the micro-computer portion.

Figure 7:
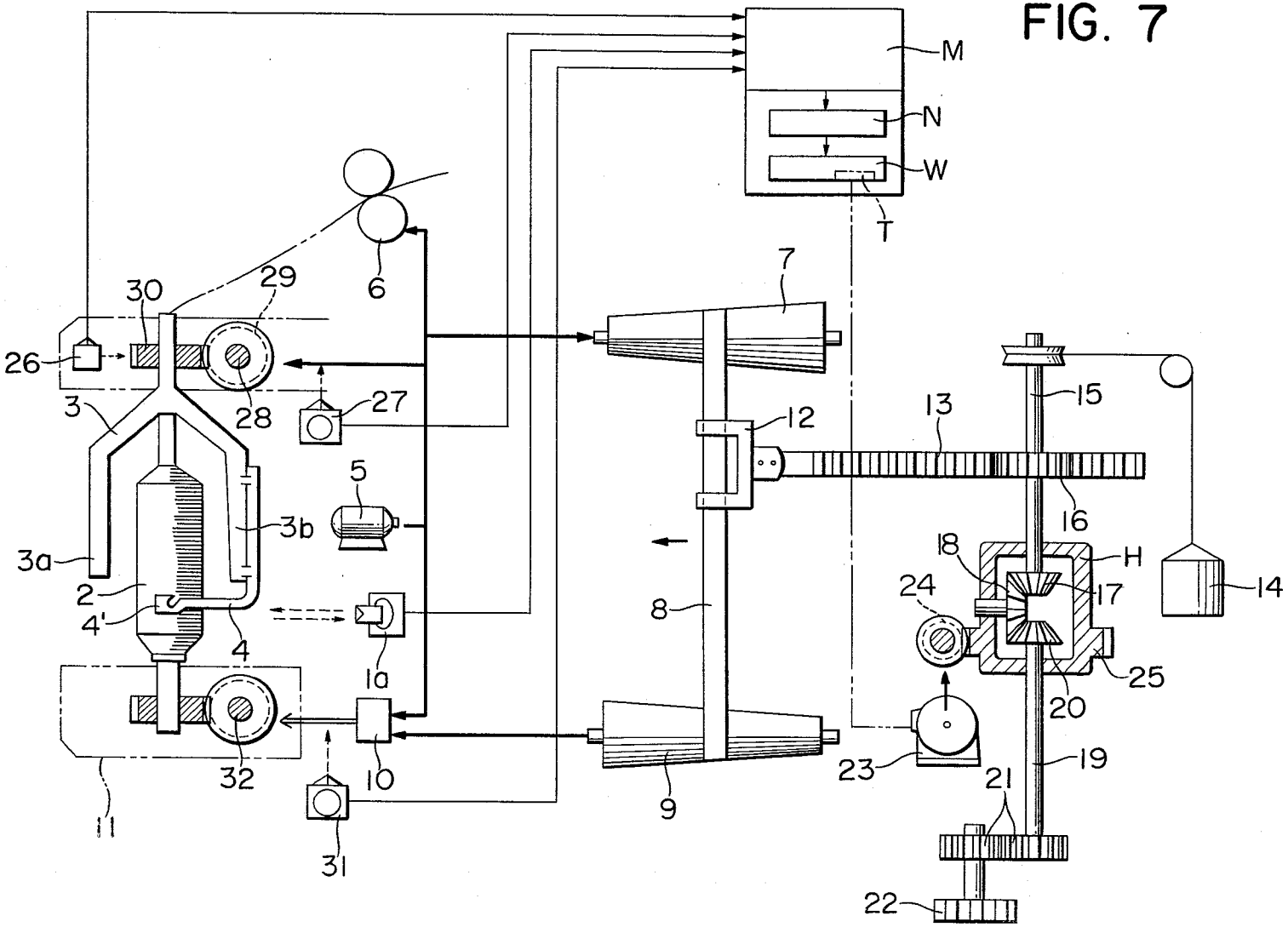
FIG. 7 is an illustrative view showing the overall control device.

When the quantity K has exceeded the control limit, the operating motor is driven in the forward or reverse direction for reducing or increasing the bobbin r.p.m. through operation of the bobbin r.p.m. control device. The resulting value for K is again measured and introduced into the micro-computer portion for repeating the aforementioned control loop. Since it is known experimentally that changes in the roving tension and hence in K caused under varying spinning conditions are extremely slow as shown by way of an example by curve S in FIG. 1, the number of times of bobbin r.p.m. correction can be reduced by once setting the quantity K to its design value $K_O$ when the value K has exceeded its control limits U.C.L. or L.C.L. shown in FIG. 1. To this effect, the bobbin r.p.m. may be changed by $\pm\Delta B=\pm K\ (N_F/D_B)$ which corresponds to $\Delta K$ in the equation 5 being equal to $\Delta K$. Since it is known in a roving machine having a cone drum type speed changer that the cone drum belt need be shifted only a preset distance without regard to the bobbin diameter prevailing at the time of such correction, the operating motor need be rotated for a preset time interval by a timer T (FIG. 7). In addition, display means for design value $K_O$, control limit $\Delta K$ and control value K may be annexed to the micro-computer portion for control purposes.

FIG. 7 shows an embodiment of the control device of the present invention applied to a roving machine having a bobbin speed changer including a pair of cone drums in a known manner. Referring first to the motion transmission system, rotation is transmitted from a main motor 5 to a front bobbin roller 6, flyer 3 and a top cone drum 7 through rotation transmission means such as gearing or timing belt. Rotation from main motor 5 and rotation from the bottom cone drum 9 driven by top cone drum 7 and belt 8 with a variable speed corresponding to the changing bobbin diameter are combined in a differential unit 10 and transmitted to the bobbin 2. Rotation of the bottom cone drum 9 is transmitted further to a vertical motion system, not shown, of a bobbin rail 11 for imparting a vertical motion to the bobbin 2.

The bobbin speed device shown in FIG. 7 is designed to provide for both the conventional belt feed and correction belt feed by annexing a differential gearing H to a conventional belt shift system adapted for shifting the cone drum belt 8. Referring first to conventional belt shift, a rack 13 has a belt shifter 12 and meshes with a gear 16 mounted on a shaft 15 rotated in turn upon downward travel of a counterweight 14. The gear 16 is operatively connected with a gear 17 coaxial therewith, a planetary gear 18 of a planetary gearing, a gear 20 on a shaft 19 coaxial with shaft 15, and with a ratchet wheel through a set of pinions 21, so that the gear 16 is rotated intermittently whenever a new roving layer starts to be formed and a pawl, not shown, is disengaged from the ratchet wheel, the cone drum belt 8 being thereby shifted a predetermined distance in the direction of the arrow mark for changing the r.p.m. of the bottom cone drum 9 and hence the r.p.m. of the bobbin 2. On the other hand, when the control value K has exceeded its control limit, the operating motor 23 forming a main part of bobbin r.p.m. control means is driven into forward or reverse rotation for effecting a compensation or correction belt shifting. Thus a worm 24 is rotated by rotation of the motor 23. The worm 24 meshes with a worm wheel 25 so that the planetary gear 18 is rotated about axis of shafts 15, 19. Since the shaft 19 is fixed by operation of the ratchet wheel 22 and the pawl meshing therewith, the shaft 15 is now rotated by rotation of the gear 18 through gear 17 so that the belt 8 is advanced or receded a required length through gear 16, rack 13 and belt shifter 12 for compensating the bobbin r.p.m. as required for resetting the control value K. It is to be noted that any other known methods or apparatus for compensation belt shifting may be used within the scope of the present invention.

Referring now to the measuring portion, one or plural non-contact distance measuring devices la are mounted on the machine bed as a function of the number of bobbin to be measured. Each device la operates for a predetermined time interval by instructions supplied from a flyer position synchro unit 26 or from the unit 26 and a bobbin position sensor, not shown, for measuring the distance l(FIG. 2) or $l_p$(FIG. 5) and transmitting the resulting information to the micro-computer, where the bobbin diameter is calculated. It is to be noted that the sync unit 26 may be designed to contact other rotating elements having the same r.p.m. as the flyer, and thus need not contact directly with the flyer. The flyer r.p.m. is measured with a rotary sensor 27. Since the flyer of the overall machine bed is driven by engagement of a gear 29 on a flyer driving shaft 28 and a gear 30 on the flyer 3, it is only necessary to provide a single set of flyer r.p.m. sensor 27 for the drive system of the shaft 28. By the same reason, one set of bobbin r.p.m. sensor 31 is mounted to the drive system for the bobbin driving shaft 32. The resulting r.p.m. signals are transmitted to the micro-computer M for operation of the control value K and offset $\Delta K$, the resulting signal current being then amplified by the amplifier N and transmitted to the output relay W for driving the operating motor 23. In FIG. 7, the route of signal transmission is shown by a thin solid line.

Figure 8:
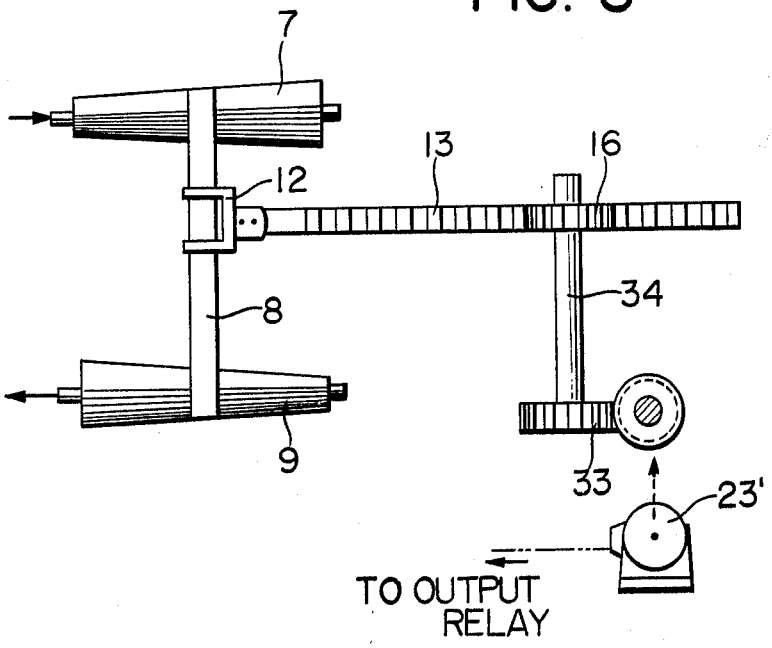
FIG. 8 is a partial view showing essential portions of a modified control device according to the present invention.

While the foregoing description has been made of a roving machine making use of a pair of cone drums, the present invention can also be applied to a roving machine having a bobbin r.p.m. control device consisting of a combination of an operating cam and the positive infinitely variable (P.I.V.) speed changer. In addition, belt shift means of a roving machine making use of a pair of cone drums can be simplified by application of the invention means. Thus the conventional belt feed system adapted for shifting the belt 8 a predetermined distance through counterweight 14 and ratchet wheel 22 (FIG. 7) for each new roving layer on the bobbin is dispensed with, and the operating motor 23′ is rotated intermittently as shown schematically in FIG. 8. Intermittent rotation of the motor is transmitted to the gear 16 directly through shaft 34 and a set of gears 33. In this manner, not only the belt 8 can be shifted a predetermined length but the belt position can be corrected by operation of the motor 23′. In addition, linear cone drums may be used instead of the hyperboloid cone drum and thereby eliminate manufacture difficulties.

For changing the bobbin r.p.m., it is also known to change the speed of a stepless speed change motor mounted directly at a position corresponding to the bottom cone drum 9 in FIG. 7, according to a preset speed change program referenced to the changing bobbin diameter. In this manner, the cone drum pair driven from main motor or P.I.V. speed changer may be dispensed with. This system has not been utilized practically, because the drive system for the flyer and front roller is distinct from that for the bobbin and the winding condition according to the equation (3)′ is difficult to maintain technically not only during normal operation but especially at the start and stop of the machine base due to difference in inertia in the respective systems and in motor characteristics. The present invention makes it possible to find the control value K instantly, to supply the micro-computer signals to the r.p.m. change unit of the stepless speed change motor during steady state operation and starting for controlling the rotational speed and to control the braking torque of the motor during stop for maintaining the constant winding tension of the roving. In this manner, the stepless speed change motor may be used practically in the bobbin speed change system.

From the foregoing it is clear that the winding speed of the roving can be controlled by using a mathematical equation representing theoretical winding conditions and while indefinite draft applied from the roving machine front roller to the roving is measured simultaneously. Therefore, the indefinite draft can be maintained within a preset control limit from the time the winding is started until the bobbin is full, resulting in the constant winding tension, uniform roving weight and the constant number of deniers of the resulting roving. In addition, the indefinite draft or winding tension, variable with occasional spinning conditions, may be set easily, and the design value thereof stored in the micro-computer can be adjusted through visual inspection of the slack in the roving travelling between the front roller and the flyer top at the start of winding. In this manner, once the design value and the control limit are set and stored in the micro-computer, the subsequent winding operation is controlled automatically by the micro-computer until the bobbin is full. Thus the operation of the device may be facilitated without requiring any special skill.

In addition, measurement may be facilitated with plural spindles and the mean value obtained from measured values for the plural spindles can be used, thus resulting in improved control accuracy. Moreover, the conventional bobbin speed change devices can be simplified and combined with bobbin r.p.m. correcting device. The present invention has practical merit in that the winding tension of the roving can be controlled automatically by resorting to the art of micro-computer and measurement technology.

What I claim is:

1. A method for automatically controlling the winding tension of a roving in a bobbin lead roving machine with the aid of a micro-computer, said method comprising the steps of:

measuring the mean bobbin winding diameter ($D_B$) for a given operating spindle of the machine;

measuring the bobbin rational speed ($N_B$) for said operating spindle;

measuring the rotational speed ($N_F$) of the flyer associated with said operating spindle;

calculating in said micro-computer a value (K) given by equation $$K = \left(\frac{NB}{N_F} - 1\right) \times D_B$$

representative of the winding condition for the roving and based on said measured values;

comparing in said micro-computer said calculated value (K) with a predetermined optimum value ($K_O$) of said roving condition; and adjusting the bobbin rotational speed when the difference between said value (K) and said optimum value ($K_O$) exceeds a preset control limit ($\delta K$) thereby automatically controlling winding tension of the roving.

2. An apparatus for automatically controlling the winding tension of a roving in a bobbin lead roving machine, said apparatus comprising:

a non-contact distance measurement device adapted for measuring a bobbin diameter ($D_B$) for one or more operating spindles;

a sensor for measuring a bobbin rotational speed ($D_B$);

a sensor for measurng a flyer rotational speed ($N_F$);

a micro-computer operative to calculate a value (K) given by the equation $K=(N_B/N_F-1)\times D_B$ representative of the winding condition for the roving, to compare the resultant value (K) with preset control limits therefor and to issue a corresponding correction signal when the value (K has exceeded said control limits;

relay means operable by said correction signal; and means responsive to the operation of said relay means for changing the bobbin rotational speed, thereby to obtain the optimum winding tension of the roving.

3. The apparatus according to claim 2, wherein the roving machine includes a bobbin driving system comprising a bobbin speed change mechanism adapted for decrementally reducing the bobbin rotational speed for each increase in the number of roving layers by one and depending on the prevailing bobbin diameter, said bobbin speed change mechanism comprising a pair of cone drums operatively associated with the bobbin, and a bobbin rotational speed correcting device having an operating motor operable in the forward or reverse direction by said signals from said micro-computer.

4. The apparatus according to claim 2, wherein the roving machine includes a bobbin driving system comprising a cone drum type bobbin speed change mechanism operatively associated with the bobbin, and an operating motor associated with said bobbin speed change mechanism to decrease the bobbin r.p.m. decrementally with each increase in the number of roving layers by one and to reduce or increase the bobbin r.p.m. upon reception of said micro-computer signals.

5. The apparatus according to claim 4, wherein said relay means includes a timer for controlling a period of time during which said operating motor is energized.

6. The apparatus according to claim 2, wherein the roving machine includes a bobbin driving system comprising a stepless speed change motor caused to be driven by said micro-computer signals to reduce the bobbin rotational speed decrementally for each increase of the number of roving layers by one land depending on the prevailing bobbin diameter.

7. The apparatus according to claim 2, wherein the roving machine includes a bobbin driving system comprising a bobbin speed change mechanism adapted for decrementally reducing the bobbin rotational speed for each increase in the number of roving layers by one and depending on the prevailing bobbin diameter, said bobbin speed change mechanism comprising a positive infinitely variable speed changer operatively associated with the bobbin, and a bobbin rotational speed correcting device having an operating motor operable in the forward or reverse direction by said signals from said micro-computer.

8. The apparatus according to claim 2, wherein the roving machine includes a bobbin driving system comprising a positive infinitely variable speed changer operatively associated with the bobbin, and an operating motor associated with said bobbin speed change mechanism to decrease the bobbin rotational speed decrementally with each increase in the number of roving layers by one and to reduce or increase the bobbin rotational speed upon reception of said micro-computer signals.

9. A method for automatically controlling the winding tension of a roving in a bobbin lead roving machine haivng a spindle for receiving a bobbin, a flyer for feeding a roving to a bobbin on said spindle, and driving means for rotating said spindle and flyer, said method comprising the steps of:

measuring the means bobbin winding diameter ($D_B$) of roving on a said bobbin on said spindle of the machine;

measuring the bobbin rotational speed ($N_B$) for said spindle;

measuring the rotational speed ($N_F$) of the flyer associated with said spindle;

calculating a value (K) given by equation $$K = \left(\frac{NB}{N_F} - 1\right) \times D_B$$

representative of the winding condition for the roving and based on said measured values;

comparing said calculated value (K) with a predetermined optimum value ($K_O$) of said roving condition; and adjusting the bobbing rotational speed when the difference between said value (K) and said optimum value ($K_O$) exceeds a preset control limit ($\delta K$) thereby automatically controlling winding tension of the roving.

10. A method according to claim 9 in which said optimum value ($K_O$) is determined at optimum slack of the roving between the front roller and the flyer top at the initial stage of winding on the drum.

* * * * *

UNITED STATES PATENT AND TRADEMARK OFFICE

CERTIFICATE OF CORRECTION

PATENT NO. : 4,467,593

DATED : August 28, 1984

INVENTOR(S) : HIDEJIRO ARAKI

It is certified that error appears in the above—identified patent and that said Letters Patent is hereby corrected as shown below:

Column 2, line 16, "and the flyer" should read --and the flyer r.p.m.--.

Column 2, line 19, "$(n_B/N_F-1)XD_B=K$," should read --$(N_B/N_F-1)XD_B=K$,--.

Column 2, line 34, "$(N_B/N_f-1)XD_B=K$," should read --$(N_B/N_F-1)XD_B=K$,--.

Column 3, line 24, "and a the" should read --and a the--.

Column 3, line 26, "draft a represents" should read --draft a represents--.

Column 3, line 40, "of the cone drum" should read --of cone drum--.

Column 3, line 46, "In order to cone" should read --In order to cope--.

Column 3, line 67, "according to equation 1)" should read --according to equation (1)--.

Column 4, line 10, "draft a and hence" should read --draft a and hence--.

Column 4, line 11, "indefinite draft a." should read --indefinite draft a.--.

UNITED STATES PATENT AND TRADEMARK OFFICE

CERTIFICATE OF CORRECTION

PATENT NO. : 4,467,593

DATED : August 28, 1984

INVENTOR(S) : HIDEJIRO ARAKI

It is certified that error appears in the above—identified patent and that said Letters Patent is hereby corrected as shown below:

Column 5, line 15, "may insure the" should read --may injure the--.

Column 5, line 44, "$D_2$ considered to be" should read --$D_2$ is considered to be--.

Column 6, line 48, "plate 4' is t;" should read --plate 4' is t,--.

Column 6, line 51, "$L-L_p=R$," should read --$L-l_p=R$,--.

Column 7, line 38, "equal to $\Delta K$." should read --equal to $\delta K$.--.

Column 7, line 45, "control limit $\Delta K$" should read --control limit $\delta K$--.

Column 10, line 7, "bobbin rational speed" should read --bobbin rotational speed--.

UNITED STATES PATENT AND TRADEMARK OFFICE

CERTIFICATE OF CORRECTION

PATENT NO. : 4,467,593

DATED : August 28, 1984

INVENTOR(S) : HIDEJIRO ARAKI

It is certified that error appears in the above—identified patent and that said Letters Patent is hereby corrected as shown below:

Column 10, line 43, "the value (K has" should read --the value (K) has--.

Column 10, line 67, "the bobbin r.p.m." should read --the bobbin rotational speed--.

Column 11, line 2, "r.p.m. upon reception" should read --rotational speed upon reception--.

Signed and Sealed this

*Twelfth* Day of *February 1985*

[SEAL]

*Attest:*

DONALD J. QUIGG

*Attesting Officer* *Acting Commissioner of Patents and Trademarks*